US011660617B2

(12) United States Patent
Ramin et al.

(10) Patent No.: US 11,660,617 B2
(45) Date of Patent: May 30, 2023

(54) THERMAL REGULATION OF ROTORS DURING CENTRIFUGATION

(71) Applicant: Beckman Coulter, Inc., Brea, CA (US)

(72) Inventors: Thomas Ramin, Fort Collins, CO (US); Eric Von Seggern, Fort Collins, CO (US); Brad Hunting, Berthoud, CO (US); Joe Schorsch, Fort Collins, CO (US)

(73) Assignee: Beckman Coulter, Inc., Brea, CA (US)

( * ) Notice: Subject to any disclaimer, the term of this patent is extended or adjusted under 35 U.S.C. 154(b) by 823 days.

(21) Appl. No.: 16/333,198

(22) PCT Filed: Sep. 13, 2017

(86) PCT No.: PCT/US2017/051400
§ 371 (c)(1),
(2) Date: Mar. 13, 2019

(87) PCT Pub. No.: WO2018/053026
PCT Pub. Date: Mar. 22, 2018

(65) Prior Publication Data

US 2021/0146380 A1 May 20, 2021

Related U.S. Application Data

(60) Provisional application No. 62/395,261, filed on Sep. 15, 2016.

(51) Int. Cl.
*B04B 15/02* (2006.01)
*B04B 7/02* (2006.01)

(52) U.S. Cl.
CPC ..... *B04B 15/02* (2013.01); *B04B 7/02* (2013.01)

(58) Field of Classification Search
CPC ..... B04B 15/02; B04B 7/02; B04B 13/00
(Continued)

(56) References Cited

U.S. PATENT DOCUMENTS 2,885,188 A * 5/1959 Oates ..... B04B 15/02 494/10
3,444,695 A * 5/1969 Waye ..... F25B 21/02 62/3.2

(Continued)

FOREIGN PATENT DOCUMENTS

DE 1018648 B * 10/1957 ..... B04B 5/0407
DE 1018648 B 10/1957

(Continued)

OTHER PUBLICATIONS

DE 1018648 Espacenet Machine Translation.*

(Continued)

*Primary Examiner* — Shuyi S. Liu
(74) *Attorney, Agent, or Firm* — Merchant & Gould P.C.

(57) ABSTRACT

The present invention provides centrifuges (e.g., analytical centrifuges) comprising a cooling assembly having a cooling surface disposed inside the centrifuge chamber and spaced apart from the rotor. The cooling surface disposed inside the centrifuge chamber, spaced apart from the rotor, and configured to exchange heat between the cooling assembly and the rotor, the thermal element thermally coupled to the cooling surface, and configured to control the temperature of the cooling surface.

22 Claims, 9 Drawing Sheets

(58) Field of Classification Search
USPC ..... 494/13, 14
See application file for complete search history.

(56) References Cited

U.S. PATENT DOCUMENTS

| | | | | |
|---|---|---|---|---|
| 4,512,758 | A * | 4/1985 | Wedemeyer | B04B 15/02 62/3.2 |
| 2008/0274511 | A1* | 11/2008 | Tan | B01L 3/50855 435/303.1 |
| 2013/0071880 | A1* | 3/2013 | Corbett | C12Q 1/686 435/91.2 |

FOREIGN PATENT DOCUMENTS

| | | | | |
|---|---|---|---|---|
| DE | 1033446 | B | 7/1958 | |
| GB | 736356 | | 9/1955 | |
| GB | 985715 | A * | 3/1965 | F25B 21/04 |
| GB | 985715 | A | 3/1965 | |
| SU | 392985 | A1 * | 8/1973 | B04B 7/02 |
| SU | 392985 | A1 | 8/1973 | |
| WO | 03/102226 | A1 | 12/2003 | |

OTHER PUBLICATIONS

Office Action for Chinese Patent Application No. 201780065258.1, dated Nov. 20, 2020.

PCT/US2017/051400, "International Search Report and Written Opinion", dated Nov. 27, 2017, 13 pages.

PCT/US2017/051400 , "International Preliminary Report on Patentability", dated Mar. 28, 2019, 8 pages.

* cited by examiner

THERMAL REGULATION OF ROTORS DURING CENTRIFUGATION

CROSS-REFERENCES TO RELATED APPLICATIONS

The present application is a US National Phase of PCT Application No. PCT/US2017/051400 filed on Sep. 13, 2017, which claims priority to US Provisional Application No. 62/395,261, filed Sep. 15, 2016, the entireties of which are incorporated herein by reference for all purposes.

BACKGROUND OF THE INVENTION

A centrifuge is commonly used to separate substances in a sample by subjecting the sample to a centrifugal force. The centrifugal force is generated by spinning a rotor containing the sample at a selected speed. Substances separate based on differences in size, weight, or density, as larger, heavier, more dense substances sediment faster in response to the centrifugal force. For example, centrifugation is used to separate solid materials that precipitate out of a liquid solution, or to form a density gradient to separate molecules based on size and density.

For some high-speed centrifuges, such as ultracentrifuges, the centrifuge chamber is a vacuum chamber. The air in the centrifuge chamber is evacuated during centrifugation to maintain a constant, low air pressure. This reduced pressure decreases frictional heating of the rotor caused by air molecules in the chamber that strike the rotor as it spins.

In an analytical ultracentrifuge, physical characteristics of a particle, such as molecular weight, can be calculated based on a determined rate of sedimentation of the particle during centrifugation. The rate of sedimentation is determined by monitoring the position of the particle along the radial length (i.e. along the axis of the centrifugal force) of a sample cell containing the sample during centrifugation. The sample cell includes a window on the top and the bottom so that the sample, and particles therein, can be observed during centrifugation. The position of the particle is detected by changes in absorbance, interference, or fluorescence along the radial length of the sample cell. To detect these changes, the analytical ultracentrifuge has an analytical module including a light source, a detector, and an optical element. The light source and optical element are configured to deliver an illuminating beam of light to the window of the sample cell and the detector is configured to measure the amount or pattern of the illuminated light after the light passes through the sample through the windows of the sample cell.

To provide the illuminating beam of light, analytical ultracentrifuges of the prior art comprise an illuminating optical subsystem including a light source and beam shaping/steering optics positioned inside the centrifuge chamber. It is desirable that components of the illuminating optical subsystem be maintained in precise alignment to provide an accurate and precise measure of particle position during centrifugation. However, because the illuminating optical subsystem is positioned inside the centrifuge chamber, it is subject to the varying temperature and pressure conditions inside the centrifuge chamber. Temperature changes can cause variation in position of the components induced by thermal expansion or contraction, thus causing optical misalignment. Reduced temperatures can cause condensation on optical surfaces, reducing the effectiveness or performance of optical components.

One prior art analytical ultracentrifuge keeps all components of the illumination optical subsystem and the detection subsystem outside the centrifuge chamber. At least a portion of the illumination optical subsystem is positioned above the centrifuge chamber, and the detection module is positioned below the centrifuge chamber. A window in the top wall of the chamber allows the illuminating light to shine onto the sample through the top of the rotor, and a window in the bottom wall of the chamber allows the light emanating from the sample to reach the detector. The positioning of at least a portion of the illuminating optical subsystem above the rotor can interfere with a user's access to the rotor, such as blocking the insertion or removal of the rotor.

In many cases, the sample processed by a centrifuge is a biological sample. Typically, these samples are maintained at a constant temperature below ambient to preserve the molecular structure or biological activity of the sample. Typically, the biological sample is maintained at a refrigerated temperature of approximately 0° to 40° C. To maintain a refrigerated temperature of a sample during centrifugation, the rotor containing the sample centrifugation is usually cooled or heated.

In some prior art systems, the rotor is cooled indirectly by cooling a wall of the centrifuge chamber containing the rotor as it spins. The cooled wall maintains a reduced temperature inside the entire centrifuge chamber, thereby indirectly cooling the rotor as it spins inside the chamber. For example, in some prior art systems, the wall of the centrifuge chamber can be cooled by a thermoelectric element placed in direct contact with the wall on the outside of the centrifuge chamber. Alternatively, coils containing a circulating coolant fluid can be placed in direct contact with the wall on the outside of the centrifuge chamber. The cooled wall can be a side wall or the floor of the centrifuge chamber. The temperature of the wall is controlled by adjusting the electrical current delivered to the thermoelectric element or by controlling the temperature of the circulating coolant fluid as is common in refrigeration systems. Because the entire chamber is typically cooled, these systems can be inefficient, requiring higher energy and a longer time to cool a rotor compared to a system that locally cools the rotor by positioning a cooling surface in close proximity to the rotor. In addition, the temperature accuracy required for an analytical ultracentrifuge is very difficult to achieve with a refrigeration-based system cooling a rotor via cooling coils in the chamber walls. Another disadvantage of systems that control the temperature of the wall of the centrifuge in order to control the temperature of the rotor inside the chamber is that the entire chamber is cooled to the same temperature. This can have deleterious effects on other components inside the centrifuge chamber, such as delicate optical components of an analytical ultracentrifuge.

Prior art analytical ultracentrifuges with a thermoelectric element in direct contact with the floor of the centrifuge include a heat sink directly coupled to the thermoelectric element to dissipate the heat absorbed from the wall and components such as the rotor of the centrifuge floor and the heat generated by the by the thermoelectric element itself. A fan typically blows air over the cooling fins of the heat sink to transfer the absorbed heat to outside the body or housing of the centrifuge. Because the heat sink is directly coupled to the thermoelectric device attached to the floor of the centrifuge chamber, the heat sink is positioned below the floor of the centrifuge chamber. The heat sink thus takes up space beneath the floor of the centrifuge chamber that could otherwise be used to house other components of the centrifuge. In particular, the heat sinks take-up space that could otherwise be used for components of the illuminating optical subsystem of an analytical ultracentrifuge, such as the light source.

Another prior art system comprises a thermoelectric device directly coupled to the rotor to control the temperature of the rotor as it spins in the chamber. This arrangement has the disadvantage that the thermoelectric device becomes a moving part that rotates with the rotor, and is thus more complex than a cooling element that remains stationary inside the centrifugation chamber.

What is needed is a temperature regulation system to cool or heat a spinning rotor in a centrifuge chamber that is more efficient, requires less energy, and is less complex than prior art systems. Ideally such a temperature control element is compatible with a vacuum chamber and minimizes changes in position or alignment of optical and/or electromechanical components inside the centrifuge chamber as the rotor spins and changes its temperature from the temperature at which the optical components are aligned and optimized. The optical alignment is typically performed at a controlled room temperature What is further needed is a temperature regulation system in an analytical ultracentrifuge that preserves space beneath the centrifuge chamber for illumination and/or detection components of the analytical module(s). The present invention addresses these and other needs.

BRIEF SUMMARY OF THE INVENTION

The present invention provides a centrifuge (e.g., an analytical centrifuge) comprising a centrifuge chamber including a chamber wall; a rotor disposed in the centrifuge chamber, the rotor arranged to spin in the centrifuge chamber; and a thermal module (in some embodiments, a cooling assembly) including a transfer surface (in some embodiments, a cooling surface) and a thermal element, the cooling surface disposed inside the centrifuge chamber, spaced apart from the rotor, and configured to exchange heat between the cooling assembly and the rotor, the thermal element thermally coupled to the cooling surface, and configured to control the temperature of the cooling surface. In some embodiments, the thermal element is a thermoelectric device. The transfer surface can be a cooling surface or a heating surface to cool or heat the rotor, respectively. In some embodiments, the thermal module includes a transfer plate and the transfer surface is on the transfer plate. The chamber may comprise a plurality of cooling assemblies. A plurality of cooling surfaces can be positioned together to define a thermal compartment around the rotor. Alternatively, multiple cooling assemblies can share a single cooling surface represented by a single piece of hardware.

In particular, the invention provides a centrifuge comprising: a rotor including a rotor surface, a centrifuge chamber configured to enclose the rotor, and one or more cooling surfaces to absorb heat from the rotor surface. The cooling surface(s) are disposed inside the centrifuge chamber and arranged facing and spaced-apart from the rotor surface. The cooling surface(s) are sized to cover at least a portion of the perimeter of the rotor surface. The portion of the perimeter covered by the cooling surface(s) can be a segment of the perimeter. In some embodiments, the cooling surface(s) surrounds the rotor.

The centrifuges of the invention may comprise one or more thermal elements disposed inside the centrifuge chamber to adjust the temperature of the cooling surface(s). Each thermal element can be reversibly coupled to a cooling surface to allow removal of the cooling surface from the centrifuge chamber.

The height of the cooling surface(s) can be selected for any desired configuration. In some embodiments, the height is less than or approximately equal to the height of the rotor. In some embodiments, the height is less than 120% of the height of the rotor. In some embodiments, the height of the cooling surface is much greater than that of the rotor, for example up to 200%, in some embodiments, up to 400% of the height of the rotor.

The distance between rotor surface and the cooling surface(s) can also be adjusted. In some embodiments, the cooling surface(s) and the rotor surface have a minimum clearance of less than 15 millimeters. In other embodiments, the minimum clearance is less than 10 millimeters or less than 5 millimeters.

The centrifuges of the invention may further comprise a second cooling surface arranged facing and spaced-apart from the rotor surface to absorb heat from the rotor surface.

The invention further provides a centrifuge comprising: a rotor including a rotor surface, the rotor configured to hold a sample, a centrifuge chamber configured to enclose the rotor, and a cooling assembly disposed inside the centrifuge chamber. The cooling assembly includes a cooling surface and a thermal element. The cooling surface is arranged spaced-apart and facing the rotor surface to absorb heat from the rotor surface. The thermal element thermally coupled to the cooling surface to adjust the temperature of the cooling surface.

The centrifuge may further comprise a heat pipe thermally coupled to the thermal element. The heat pipe is arranged to transfer heat from the thermal element to outside the centrifuge chamber. In some embodiments, a heat sink is disposed outside the centrifuge chamber. The heat sink is thermally coupled to the heat pipe to dissipate the heat transferred from the thermal element.

In some embodiment, the rotor includes a window to view the sample and the centrifuge further comprises an optical element disposed inside the centrifuge chamber to deliver a beam of light to the window. In some embodiments, the cooling surface is disposed between the optical element and the rotor surface. The centrifuge may further comprise a light source and a detector disposed outside the centrifuge chamber. The light source is arranged to deliver a beam of light to the optical element, wherein the rotor includes a second window, and wherein the detector is arranged to receive a beam of light emitted through the second window. In some embodiments, the light source and the detector are disposed beneath the chamber floor.

The invention further provides a centrifuge comprising: a rotor configured to hold a sample, a drive coupled to the rotor to spin the rotor, and a cooling surface arranged facing and spaced-apart from the rotor to cool the rotor, wherein the minimum clearance between the rotor and the cooling surface is less than 15 millimeters. In some embodiments, the minimum clearance between the rotor and the cooling surface is less than 10 millimeters, in other embodiments, the minimum clearance between the rotor and the cooling surface is less than 5 millimeters. The centrifuge may further comprise a centrifuge chamber configured to enclose the rotor, wherein the cooling surface is disposed inside the centrifuge chamber.

DETAILED DESCRIPTION OF THE INVENTION

Figure 1:
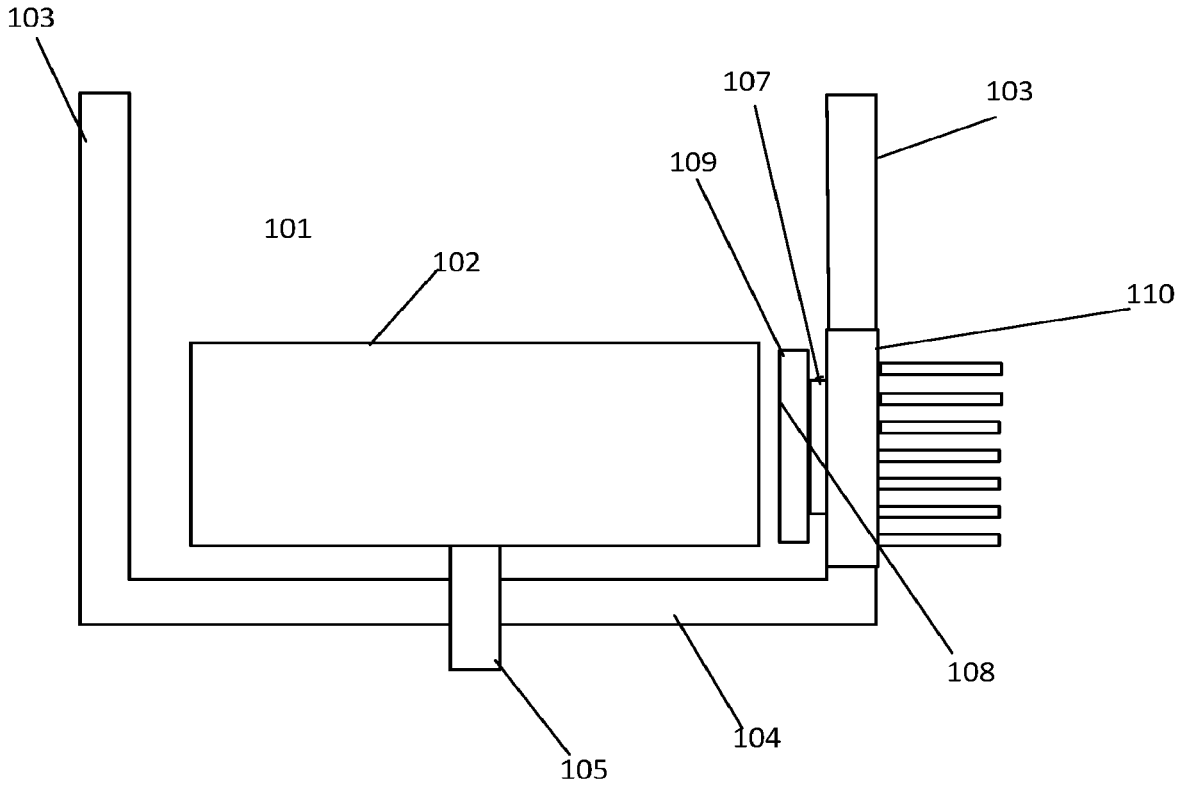
FIG. 1 depicts a side view of a centrifuge chamber of the invention.

The invention provides centrifuges (e.g., analytical ultracentrifuges) in which the rotor is cooled locally by a cooling surface positioned close to the surface of the rotor and thermally coupled to a thermal element positioned in the centrifuge chamber. This avoids the need to cool the entire centrifuge chamber, thus allowing faster cooling of the rotor with less energy, while minimizing the cooling of other components in the chamber. In the case of analytical ultracentrifuges, the centrifuge chamber can be maintained at a temperature closer to ambient temperature, thus avoiding the problems of subjecting optomechanical components present in the chamber to large changes in temperature.

More specifically, placing the cooling surface inside the centrifuge chamber allows the cooling surface to be positioned as close as practical to the rotor surface. This close proximity concentrates the heat transfer to and from the rotor, while at the same time minimizing heat transfer to or from other components in the chamber, such as components of an analytical module. Minimizing heat transfer to or from other components that do not need to be heated or cooled reduces energy consumption. Moreover, minimizing heat transfer to or from other components in the chamber minimizes the deleterious effects of thermal expansion and contraction of those components, such as the misalignment of delicate optical components of an analytical module caused by the thermal expansion or contraction.

Furthermore, placing the cooling surface inside the centrifuge chamber, (i.e. separate from the chamber walls) allows the size and shape of the cooling surface to be customized for optimal cooling of the rotor and minimal cooling of other components in the centrifuge chamber. Sizing the cooling surface to cover the height of the rotor, for example, improves the geometric form factor, providing an increased rate of heat transfer. By not extending the cooling surface a significant distance above or beyond the rotor, less energy is wasted, since a cooling surface in such extended segments does not effectively cool the rotor. Moreover, reducing the size of the cooling surface to that which covers the rotor, (i.e. eliminating surfaces that do not cover the rotor), reduces the thermal mass of the cooling surface, providing further reduction in energy consumption.

Placing the cooling surface inside the centrifuge chamber is further advantageous because it allows the use of cooling surfaces that are easily replaceable, each cooling surface optimized for a given rotor. This is in contrast to prior art centrifuges that cool the rotor by cooling the centrifuge chamber itself, which is not removable and which is of a fixed size that cannot be optimized for different rotors.

The cooling surface may be divided into segments. Using segmented cooling surfaces, where each cooling surface covers only a portion of the rotor, is advantageous because it allows each segment to be placed in close proximity to the rotor at a position optimal for cooling the rotor. Furthermore, the positions of the individual segments can be adjusted to allow for optimal cooling of different-sized rotors. The segmented cooling surfaces also allow for gaps to be placed between adjacent cooling surfaces to allow space for other components, such as those of an analytical module, to be placed about the rotor.

The cooling surface may be coupled to a thermal element, such as a thermoelectric device, to adjust the temperature of the cooling surface. Positioning the thermal element inside the centrifuge chamber advantageously facilitates positioning the cooling surface close to the rotor (inside the chamber). Positioning the thermal element inside the centrifuge chamber also allows heat transfer to be limited to the cooling surface, thereby minimizing the energy wasted in cooling other components of the centrifuge, including the walls of the centrifuge chamber.

The thermal element, positioned inside the centrifuge chamber, may be coupled to a heat pipe to transfer heat from the thermal element to a location outside the centrifuge chamber. The heat pipe may be coupled to a heat sink positioned outside the centrifuge chamber to dissipate the heat transferred from the thermal element. The use of a heat pipe to transfer heat from the thermal element to the heat sink advantageously allows the heat sink to be positioned at any suitable location outside the centrifuge chamber. Thus, unlike prior art systems, analytical ultracentrifuges of the invention do not limit the positioning of the heat sink to a location under the centrifuge chamber, or to any particular orientation relative to the rotor, which preserves space beneath the centrifuge chamber for optical subsystems (e.g., illumination and/or detection components) of the centrifuge.

The standard components of the centrifuges of the invention, including analytical ultracentrifuges, are well known to those of skill in the art and are not described in detail here. The centrifuges will typically comprise a housing, a centrifuge chamber, a rotor, a drive, control elements, and integrated analytical equipment. Control elements can include drive control elements to control the rotation of the rotor and vacuum control elements to control the air pressure inside the centrifuge chamber. The centrifuge can be floor-model or benchtop centrifuge.

FIG. 1 shows a side view of a centrifuge chamber 101 in a centrifuge of the invention. The centrifuge chamber 101 forms a containment compartment that encloses the rotor 102 and isolates the rotor from other mechanical components of the centrifuge. The centrifuge chamber comprises side walls 103, a chamber floor 104 and an upper wall (not shown). The upper wall typically includes a door to allow access to the centrifuge chamber to insert and remove the rotor. In some embodiments, the centrifuge chamber 101 is a sealed, vacuum chamber, where a vacuum source (not shown) is coupled to the centrifuge chamber to reduce the atmospheric pressure inside the chamber during a centrifugation run. For example, the atmospheric pressure inside the centrifuge chamber can be maintained at 1 to 5 micro-meters of mercury during centrifugation.

The rotor 102 is configured to hold samples and subject the samples to a centrifugal force by spinning the samples in the centrifuge chamber 101. In some embodiments, the sample is contained in a tube, and the rotor 102 has cavities to receive the tubes. The cavities can be fixed at a constant angle. In other embodiments, the cavities are allowed to swing into a horizontal position under centrifugal force. The rotor 102 can be made of metal, fiberglass, plastic, or any suitable material that is strong enough to withstand the forces during centrifugation. In some embodiments, the rotor 102 includes a sample cell containing windows on the top and bottom of the sample cell. This allows sedimentation of particles in the sample to be monitored by optical modules in an analytical ultracentrifuge.

A drive 105 is coupled to the rotor 102 to cause rotation of the rotor 102 in the centrifuge. In some embodiments, the drive 105 includes a motor and a spindle (not shown). The rotor 102 reversibly mounts onto the spindle; the motor turns the spindle, causing rotation of the rotor 102 mounted on the spindle. The motor can be an induction motor, a DC motor, or any suitable motor.

In the embodiment shown in FIG. 1, a thermal element 107 is attached to a side wall 103 of the chamber 101. The thermal element 107 directly controls the temperature of the rotor 102 inside the centrifuge chamber 101. In some embodiments, the thermal element 107 is coupled to a transfer plate 109 to provide a larger surface area for controlling the temperature of the rotor 102. The transfer plate 109 includes a cooling surface 108 to absorb heat from the surface of the rotor 102. In a typical embodiment, cooling surface 108 is functional between a minimum temperature of −20° C. and 60° C. In embodiments in which a transfer plate is not used, the cooling surface 108 is a surface of the thermal element 107. The cooling surface 108 is typically positioned proximate, but apart from the rotor 102. Because it is positioned apart from rotor 102, the cooling surface 108 remains stationary in the centrifuge chamber while the rotor 102 spins. This simplifies the mechanical design, since wires or other coupled components do not have to be attached to an element spinning with the rotor at high RPM. The cooling surface 108 is positioned proximate to the rotor 102 so that heat can be absorbed effectively from the rotor 102 and thereby control the temperature of the rotor 102, while minimizing temperature changes elsewhere in the centrifuge chamber 101, including the walls of the centrifuge chamber or sensitive optical or electromechanical components positioned inside the centrifuge chamber.

The cooling surface 108 is positioned at a distance from the rotor 102 close enough to provide efficient heat exchange between the cooling surface 108 and the rotor 102, while maintaining a safe separation from the rotor 102. For example, the cooling surface 108 can be positioned such that the minimum distance between the rotor 102 and the cooling surface 108 can be less than about 15 millimeters, or less than 10 millimeters, or less than about 5 millimeters. One of skill will recognize that the distance can be selected to maintain a desired temperature behavior of the rotor and that the distance will determine the heat transfer, power and control parameters of the system.

One of skill will recognize that, if the exchange of heat is intended to be limited to the rotor and the cooling surface, the gap between the cooling surface and the rotor, along with heat transfer media and the radiation transport properties of the participating surfaces, dictate the rate of heat transfer. An ultracentrifuge is typically operated in a vacuum environment where heat transfer is a function of the temperatures, the properties of the surfaces (e.g., emissivity and absorptivity), and the geometric view factor relationships between the surfaces. The geometric view factor between two surfaces is a measure of the fraction of the thermal radiation emitted by one surface which is intercepted by the other surface. Surface geometric relationships between the cooling surfaces and the rotors of the invention are typically designed to have a high geometric view factor. One implementation of a high geometric view factor is to arrange the cooling surface as close to and over as large a region of the rotor surface as feasible. The minimum gap size is dictated by the mechanical constraints such as runout and wobble of the rotor in order to avoid any collisions between the rotor and the cooling surface. In some embodiments, to optimize the geometric view factor while minimizing the transfer of heat to other components inside the centrifuge chamber, the height of the cooling surface 108 is less than or approximately equal to the height of the rotor 102. In some embodiments, the height of the cooling surface 108 is less than 120%, or less than 115%, or less than 110%, or less than 105% of the height of the rotor 102.

In order to maximize the heat transfer rate between the rotor and the cooling surface, the surface conditions of the rotor and the cooling surface must be selected so that absorptivity and emissivity are high in their operational temperature ranges. Other regions of the transfer plate and the rotor not involved in heat transfer are typically designed to have poor radiation heat cooling surface properties to minimize the cooling of other components in the centrifuge chamber. The geometric view factor between the cooling surface 108 and the surface of the rotor 102 can be greater than 0.5, or greater than 0.6, or greater than or equal to 0.7. In some embodiments the view factor approaches 1.0, for example, 0.97 or greater.

The cooling surface 108 is designed to cool the rotor 102. Heat from the rotor 102 is absorbed through the air (or vacuum) separating the rotor 102 and the cooling surface 108. Heat is transferred in the opposite direction when the cooling surface 108 is used to heat the rotor 102. The thermal element 107 controls the amount and rate of cooling (or heating) of the rotor 102 by controlling the temperature of the cooling surface 108.

The thermal element 107 can cool or heat the rotor 102 by a number of mechanisms. For example, the thermal element 107 may comprise coils containing a circulating fluid for heating or cooling the thermal element 107 and thus the rotor 102. In some embodiments the thermal element 107 is a thermoelectric device (also called a Peltier device). Such devices have two sides, a "hot" side and a "cool" side. When direct current flows through the device, heat from the "cool" side is brought to the "hot" side. The "hot" side is typically attached to a heat sink so that it remains at ambient temperature, while the "cool" side drops below ambient temperature. By reversing polarity, the temperature of the two sides can be reversed. A typical thermoelectric device used in the centrifuges of the invention operates at 60 W max at 0° C. delta T across it. The maximum delta T across the device used in this invention is usually 55° C.

The thermal element 107 may be thermally coupled to a heat sink 110 to dissipate the heat absorbed by the thermal element 107 and the heat generated by the operation of the thermal element 107 itself. The thermal coupling of the heat sink 110 can be through direct contact of through highly thermally conductive passive devices such as heat pipes. The heat sink 110 is often cooled with ambient air. A fan may blow air over the heat sink to help dissipate the heat from the heat sink to outside the centrifuge. Alternatively, a circulating fluid may be used to dissipate the heat from the heat sink.

Figure 2:
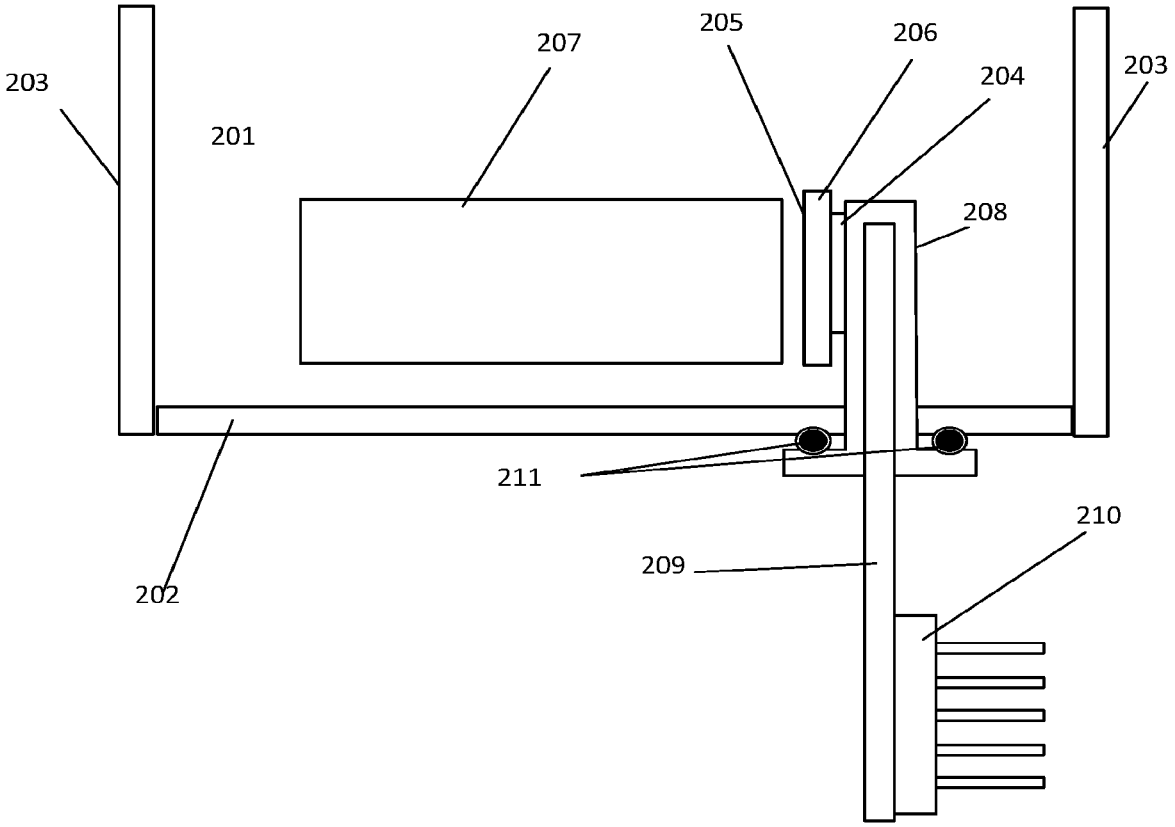
FIG. 2 depicts a side view of a centrifuge chamber of the invention.

FIG. 2 is a side view of another embodiment of a centrifuge chamber 201 of the invention comprising a floor 202 and a wall 203. In this embodiment the thermal element 204 (e.g., a thermoelectric device) and transfer plate 206 comprising a cooling surface 205 are spaced apart from the wall 203 of the centrifuge chamber 201. The thermal element 204 is attached to a mechanical interface 208, which encloses a heat pipe 209 connected to a heat sink 210. The mechanical interface, 208 is designed to effectively transfer thermal energy to the embedded heat pipes. Heat pipes are well known to those of skill in the art and are not described in detail here Briefly, a heat pipe comprises a fluid (e.g., ammonia, alcohol, or water) inside a thermally conductive solid surface (e.g., copper). The fluid turns into a vapor by absorbing heat from the thermally conductive solid surface at the hot interface and travels along the heat pipe to the cold interface and condenses back into a liquid. The liquid is then returned to the hot and the cycle repeats. One of skill will recognize that different heat pipe designs have different operational ranges. For example, the operational range of water filled heat pipes is typically 5 C to 120° C. The connection between the mechanical interface 208 and the floor 202 can include a seal 211 to maintain a vacuum in the chamber 201.

In some embodiments, to provide maximum heating or cooling of the rotor 207 while minimizing heating or cooling of the chamber walls 203, the cooling surface 205 is positioned proximate to the rotor 207 and apart from the walls 203 of the chamber, such that the minimum distance between the cooling surface 205 and the surface of the rotor 207 is less than the minimum distance between the cooling surface 205 and any wall 203 of the centrifuge chamber 201. In some embodiments, the average distance between the cooling surface 205 and the surface of the rotor 207 is less than the average distance between the cooling surface 205 and the walls 203. Other factors can also affect the heat transfer rate, such as, emissivity/adsorption, view factor and temperature of the surface. For example, adding a an actively cooled lid to the cooling system can affect cooling by improving the view factor. In some embodiments, the surface of the thermal element 205 may contact a wall 203. In these embodiments, to maximize the exchange of heat between the cooling surface 205 and the rotor 207 while minimizing the exchange of heat between the cooling surface 205 and the wall 203, the area of the thermal element 204 in contact with the wall 203 is less than the area of the cooling surface 205 proximate the rotor. Alternatively, the minimum distance between the center of the cooling surface 205 and the surface of the rotor 207 can be less than the minimum distance between the center of the cooling surface 205 and a surface of the wall 203. Minimizing the heating or cooling of the chamber walls minimizes the energy wasted in heating or cooling the rotor 207. Alternatively, to minimize the heat transfer to other components in the vacuum chamber a thermally insulating layer can be added to the portions of cooling surface 205 facing the chamber walls. This would typically be comprised of one or a plurality of highly reflective surfaces which have a minimized conduction path between the reflective surfaces.

Figure 3A:
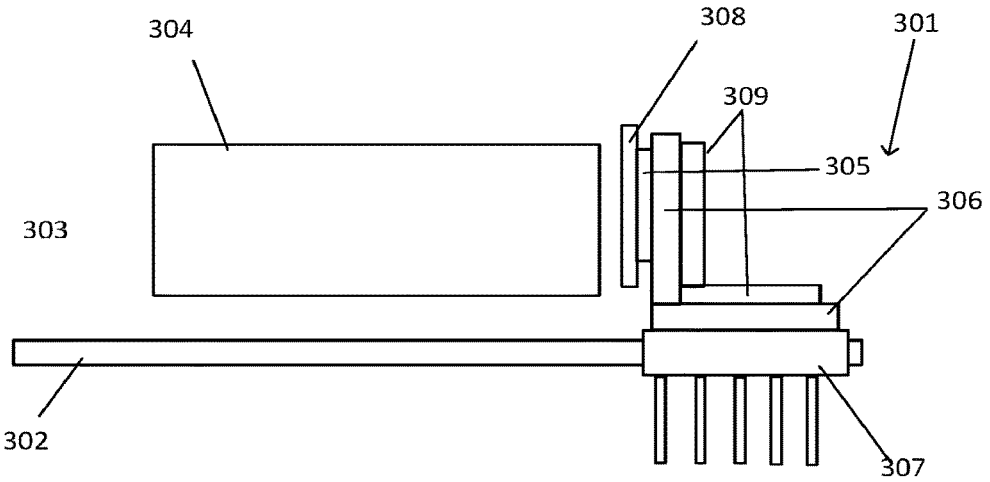
FIG. 3A depicts a side view and FIG. 3B depicts a top view of a centrifuge chamber of the invention.
Figure 3B:
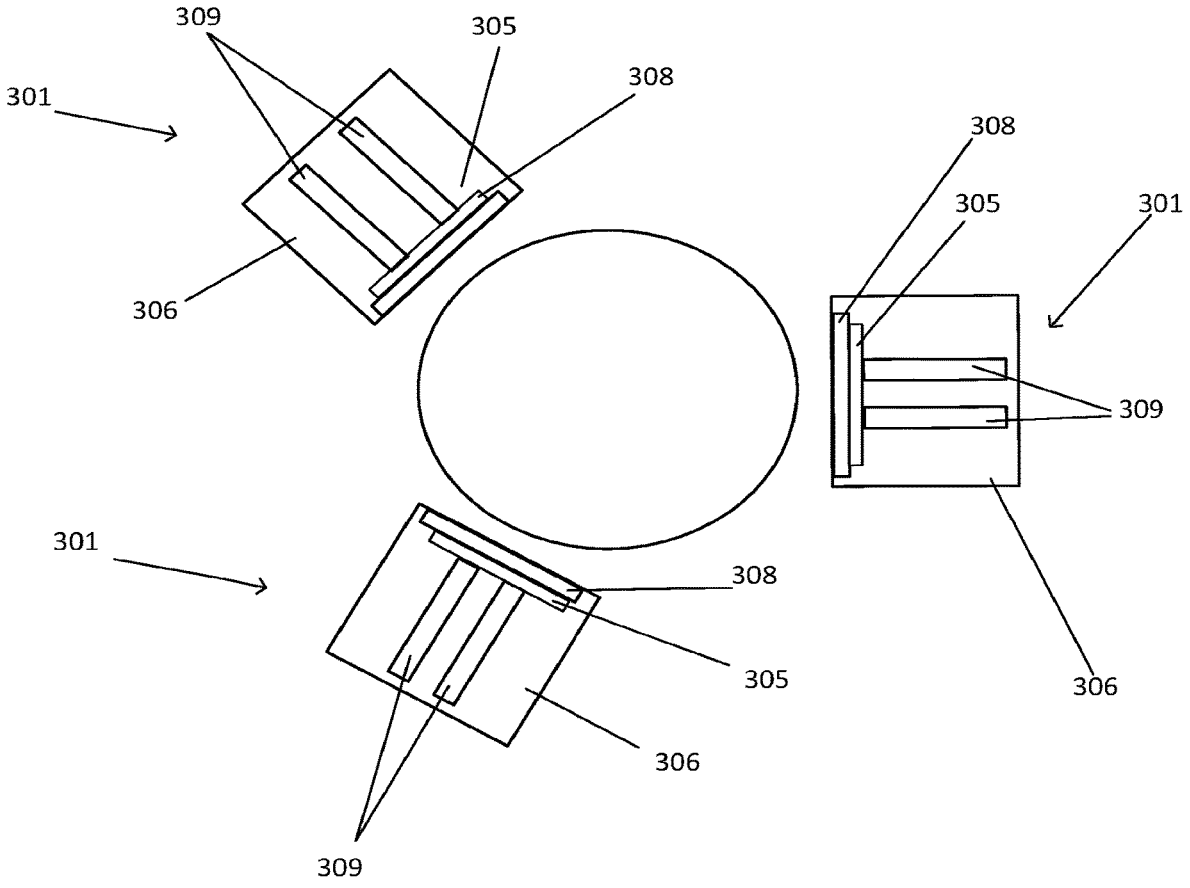

FIG. 3A is a side view and FIG. 3B is top view of another embodiment of the invention. In this embodiment, a plurality of cooling assemblies 301, are positioned on the chamber floor 302 of the centrifuge chamber 303 surrounding the rotor 304. Each cooling assembly 301 comprises a thermal element 305 (which can be a thermoelectric device) connected to a heat transfer plate 308 and a heat sink 307 through heat pipes 309 and heat spreaders 306. Heat is absorbed from the rotor 304 by the surface of transfer plate 308 and transferred to heat pipes 309 and ultimately to the heat sink 307.

Figure 4A:
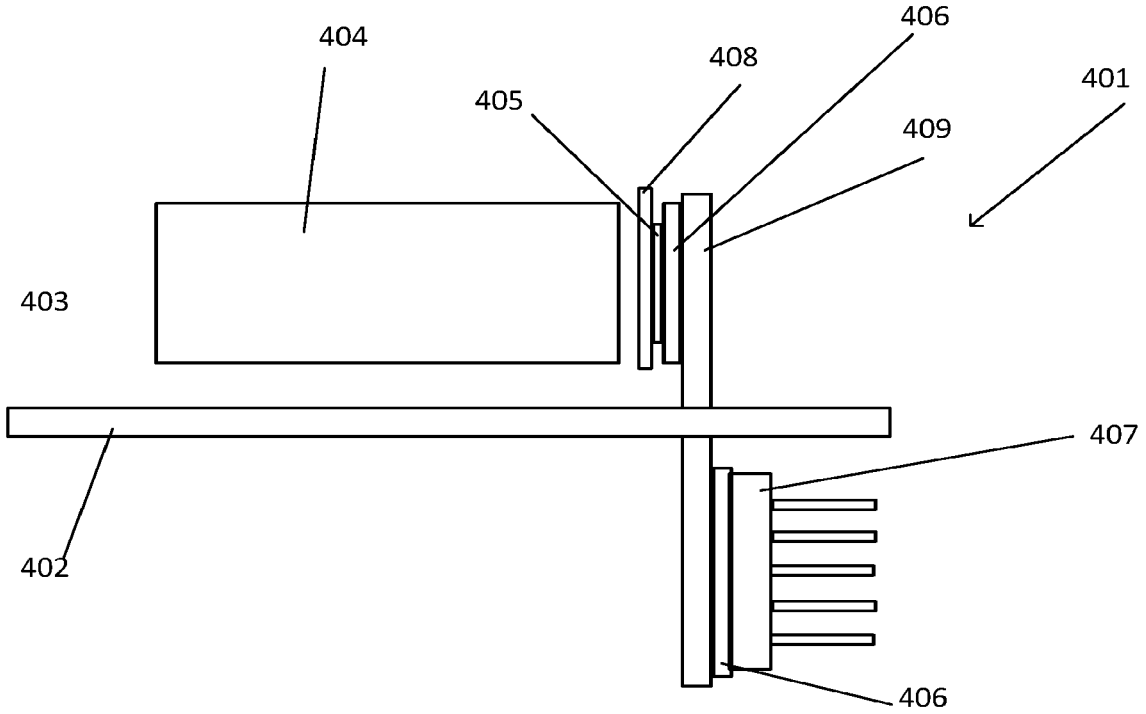
FIG. 4A depicts a side view and FIG. 4B depicts a top view of a centrifuge chamber of the invention.
Figure 4B:
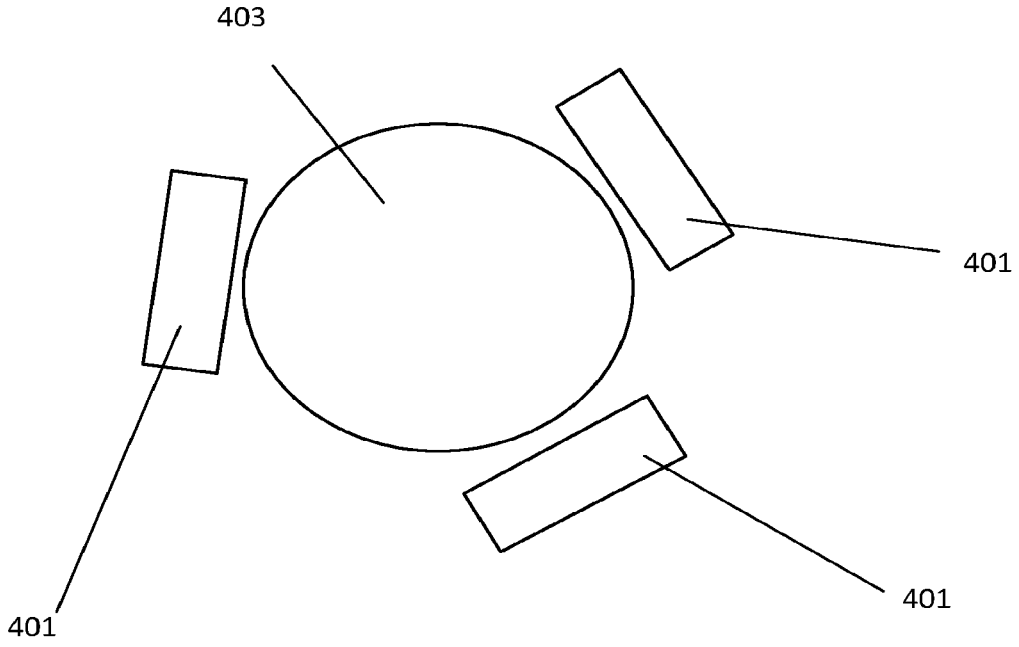

FIG. 4 is a side view and FIG. 4B is a top view of an embodiment of the invention similar to that shown in FIGS. 3A and 3B. In this embodiment, a plurality of cooling assemblies 401, are positioned on the floor 402 of the centrifuge chamber 403 surrounding the rotor 404. Each cooling assembly 401 comprises a thermal element 405 (which can be a thermoelectric device), which is positioned between a transfer plate 408 and a heat spreader 406. Heat is absorbed from the rotor 404 by the surface of transfer plate 408 and transferred through heat pipes 409 and ultimately to the heat sink 407.

Figure 5:
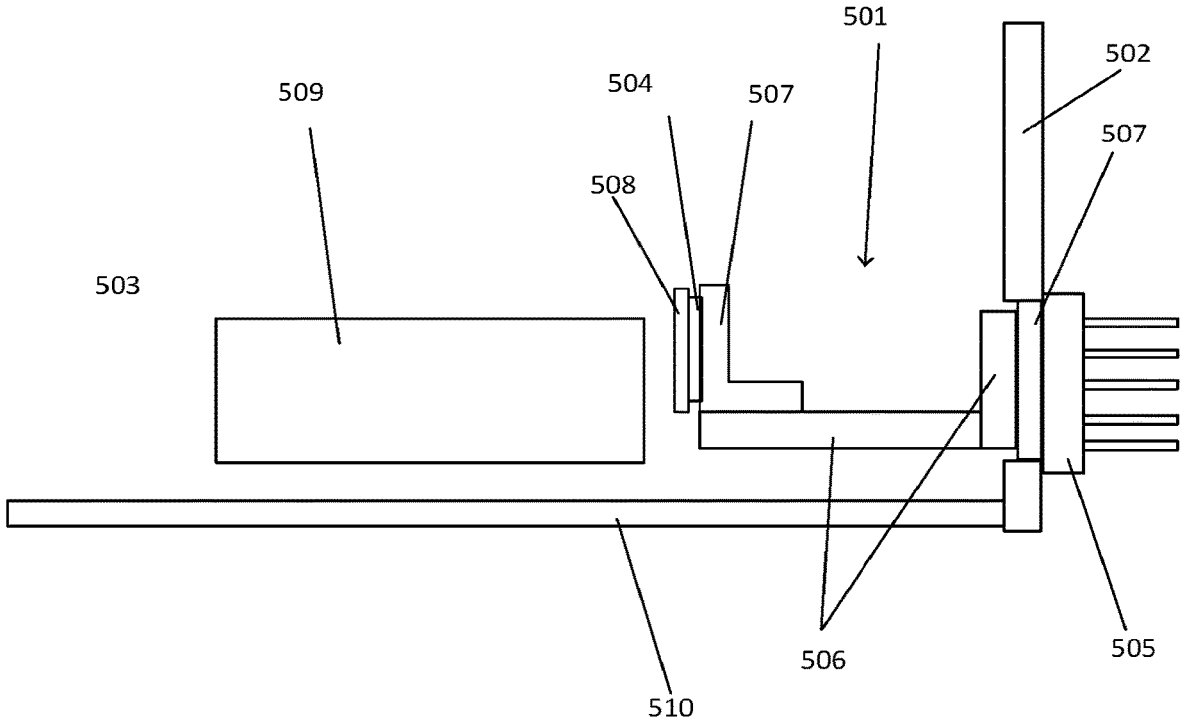
FIG. 5 depicts a side view of a centrifuge chamber of the invention.

FIG. 5 is a side view of another embodiment in which cooling surface 508 is spaced apart from the wall 502 of the chamber 503 and is proximate to the rotor 509. In this embodiment, the cooling assembly 501 is attached to the wall 502 of the chamber 503, instead of the floor 510. As in other embodiments, a plurality of cooling assemblies 501 may be positioned in the chamber 503. Each module comprises thermal element 504 connected to a heat sink 505. Heat pipes 506 connect the thermal element 504 to the transfer plate 507 so that the cooling surface 508 is proximate to the rotor 509.

Figure 6A:
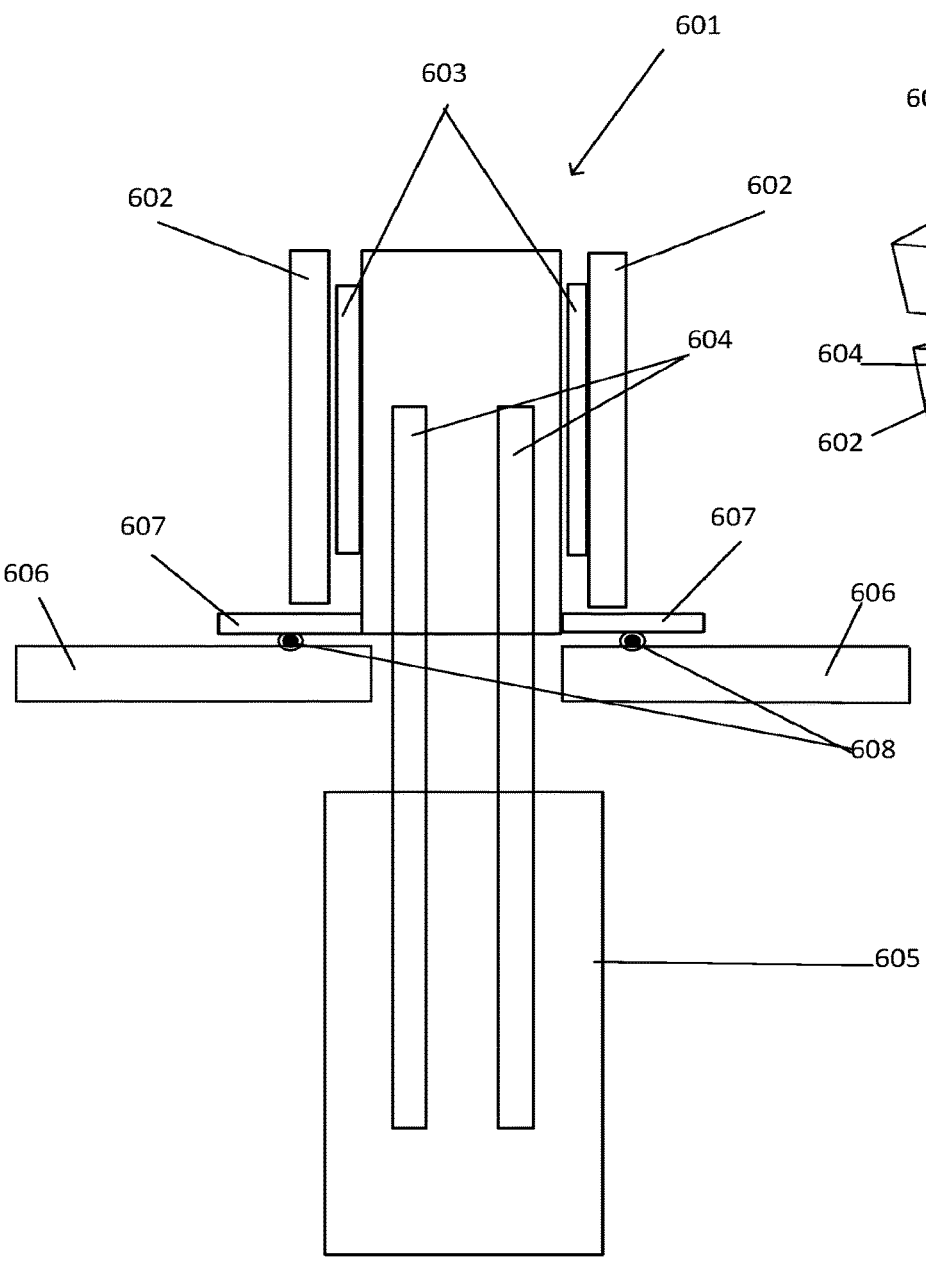
FIG. 6A and 6B depict a cooling assembly of the invention.
Figure 6B:
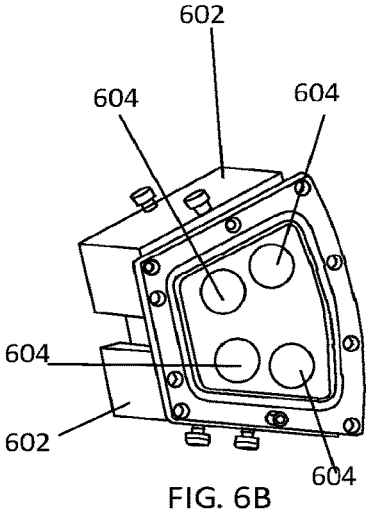

FIGS. 6A and 6B depict a cooling assembly 601 comprising transfer plates 602, thermal elements 603 and heat pipes 604, which thermally couple the thermal elements 603 to the heat sink 605. The cooling assembly 601 is attached to the floor 606 by a base plate 607, which includes a vacuum seal 608.

Figure 7A:
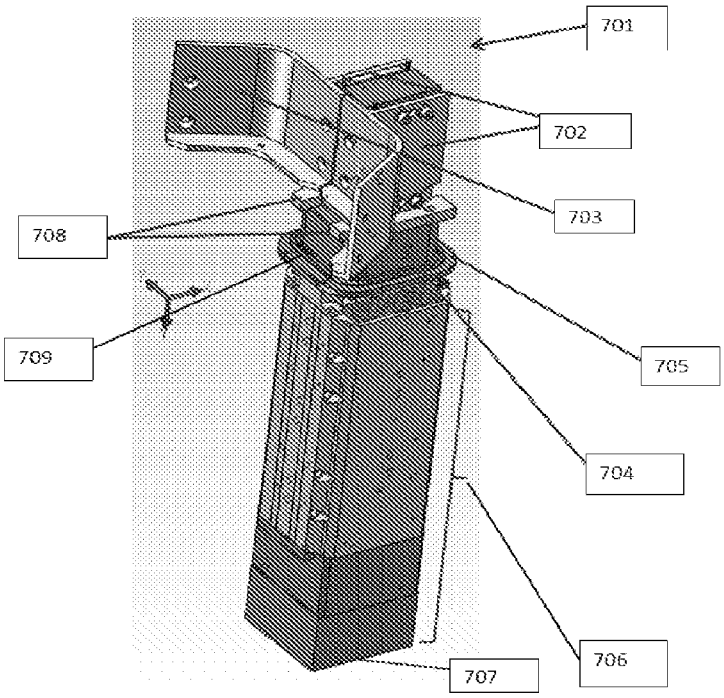
FIGS. 7A, and 7B, depict a cooling assembly of the invention.
Figure 7B:
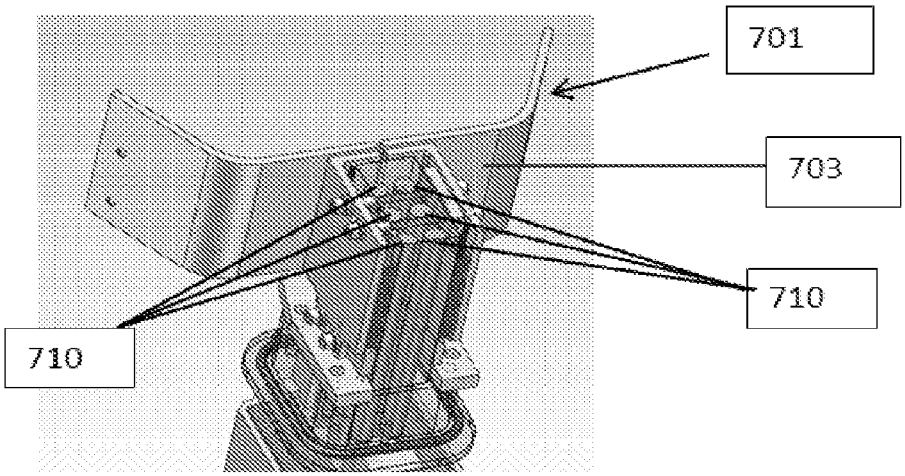
Figure 7C:
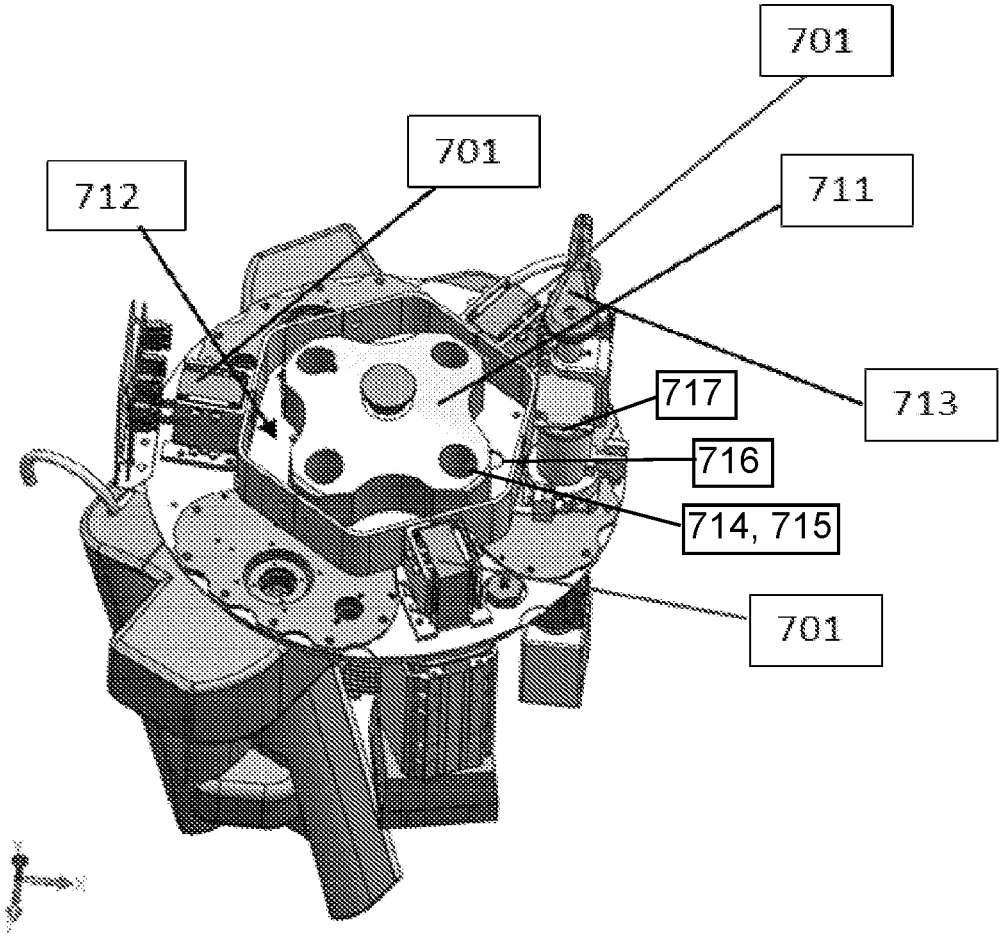
FIG. 7C depicts a top view of a centrifuge chamber of the invention.
Figure 8A:
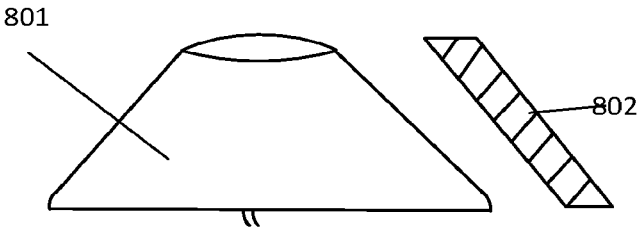
FIG. 8 (including FIGS. 8A-8K) depicts different embodiments of rotors and cooling surfaces of the invention.
Figure 8B:
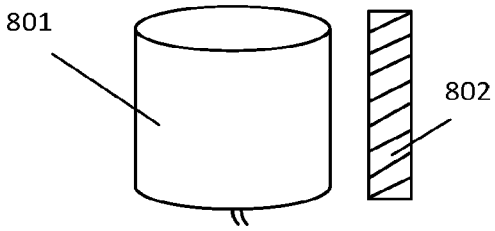
Figure 8C:
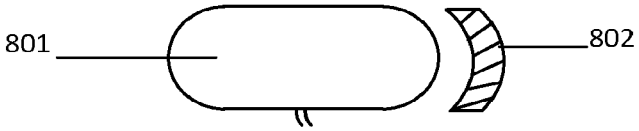
Figure 8D:
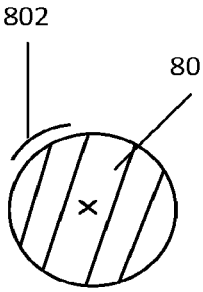
Figure 8E:
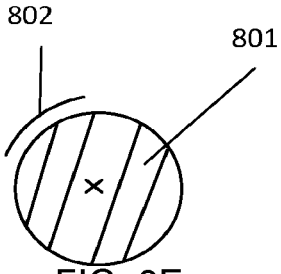
Figure 8F:
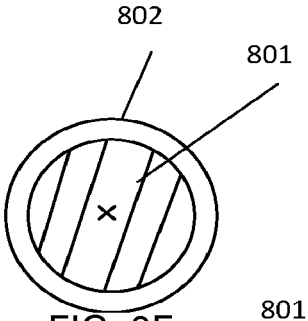
Figure 8G:
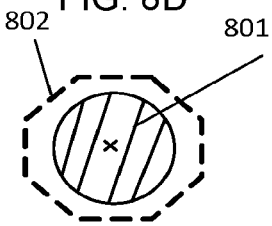
Figure 8H:
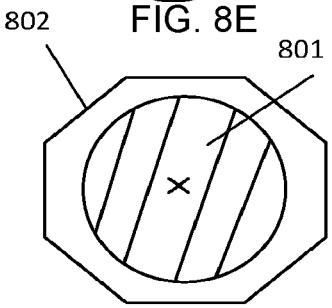
Figure 8I:
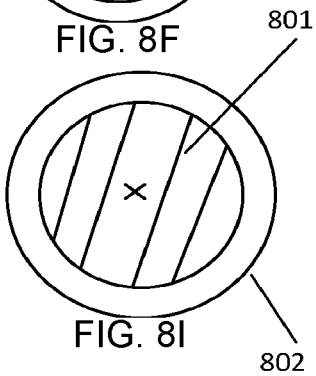
Figure 8J:
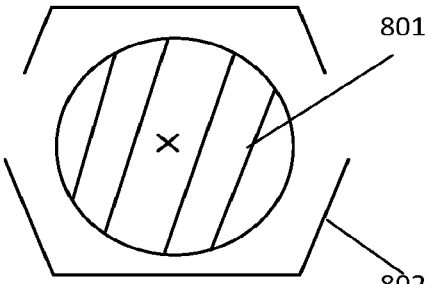
Figure 8K:
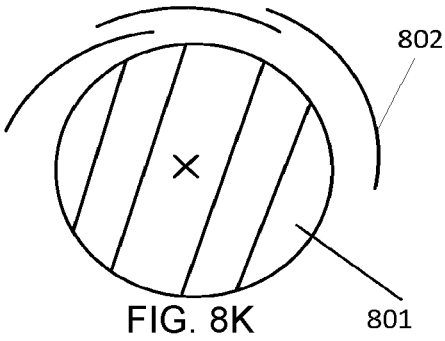

FIGS. 7A, 7B and 7C depict cooling assemblies 701 comprising transfer plates 703 and 702, which conduct heat to and from a thermoelectric device (not shown) inside the cooling assembly 701 and a rotor. In this embodiment, a TE block 704 is included to provide a mechanical interface to the thermoelectric device and to provide a thermal path from the thermoelectric device to heat pipes 710. The heat pipes 710 provide a thermal connection to the heat sink assembly 706, which includes a fan 707 to cool the heat sink. The cooling assembly 701 is held in place on the floor of the centrifuge chamber by vacuum clamps 708, which pull the vacuum sealing surface 705 and 0 ring 709 against the floor to provide a vacuum seal. FIG. 7B shows the position of 6 heat pipes 710 inside the cooling assembly 701. FIG. 7C shows the positioning of the cooling assemblies 701 around a rotor 711 thereby creating thermal compartment 712 around the rotor 711. An optical element 713 is outside the thermal compartment 713. The optical element 713 receives a beam of light from a light source 716, and delivers the beam of light onto a window 714 in the rotor 711 to illuminate a sample in the rotor 711. The optical element 713 can be any suitable combination of mirrors, lenses, optical fibers, or the like to define a light path. In the embodiment shown in FIG. 7C, the optical element 713 is rotatable along a vertical axis to allow access to the rotor 711. The rotor 711 includes a window 714 to view the sample. The centrifuge includes an optical element 713 disposed outside the centrifuge chamber to deliver a beam of light to the window 714. The light source 717 and a detector 716 disposed outside the centrifuge chamber, wherein the light source 717 is arranged to deliver a beam of light to the optical element 713, wherein the rotor includes a second window 715 (bottom side of rotor 711), wherein the detector 716 is arranged to receive a beam of light emitted through the second window 715.

The cooling surface defined by transfer plates 703 on the thermal elements 701 can be in a variety of dimensions and shapes. For example, the cooling surface can be in the shape of a one-piece ring that entirely encircles the rotor 711 when looking down from above the rotor 711. In this embodiment, the ring has a bottom with openings needed for the analytical module, surrounding the rotor from three sides and forming a thermal can. This embodiment may also comprise a thermally coupled top attached to the walls of the can. This would completely enclose the rotor. The top has corresponding openings to allow the operation of the analytical modules.

In another embodiment, each thermal element 701 includes two cooling surfaces. The first is disposed inside the centrifuge chamber 712 proximate the rotor 711 to control the temperature of the rotor 711, usually the side of the rotor 711. The second is disposed proximate to the drive to cool the drive as it spins the rotor 711. The second surface can be attached to the floor of the centrifuge. The first and second surfaces can be continuous. In other embodiments, the cooling surface is formed by two or more curved or arc segments positioned around the rotor.

In other embodiments, the cooling surface is formed by two or more straight segments positioned outside the periphery of the rotor. In some embodiments, the radial position of the cooling surface is adjustable to accommodate different-sized rotors in the centrifuge chamber. In such embodiments, the thermal element is reversibly coupled to the cooling surface to allow removal and/or prepositioning of the cooling surface from the centrifuge chamber. In one embodiment, the centrifuge is an analytical ultracentrifuge and the cooling surface comprises three arc segments centered 120° apart. Spacing between the arc segments provides space for up to three optical modules to be positioned inside the centrifuge chamber between the arc segments. The optical modules can include, for example, an absorbance-scanning module, a fluorescence scanning module, and an interference imaging module. The optical module can be positioned below the floor of the chamber and include a light pipe to deliver illuminating light onto the top of the rotor to irradiate a sample in the rotor.

FIG. 8 (including FIGS. 8A-8K) shows different embodiments of the invention showing different arrangements of rotors 801 and cooling surfaces 802 of the invention. As shown there, the shape of the cooling surface opposed to the rotor can be flat or curved. The surface may be curved to match a curve of the outer surface of the rotor. The thermal control surface may extend above or below the opposing surface of the rotor. The cooling surface may extend even with the opposing surface of the rotor. The rotor 801 may have a non-circular cross-section, with an effective diameter defined as twice the distance from the axis of rotation to the farthest point on the surface of the rotor 801 from the axis. In some embodiments of the invention, the cooling surface(s) 802 forms a ring around the rotor 801, where the ratio of the effective diameter of the rotor 801 to the diameter of the ring formed by the cooling surfaces 802 is greater than 0.5, or greater than 0.6, or greater than 0.7.

A temperature gradient and consequently convective mixing can occur in the sample cell due to differences in radiative heat transfer from the top/bottom of the sample cell and sample fluid. This convective differential can be caused by a temperature gradient throughout the rotor or by a difference in direct radiative heat transfer into the sample fluid from above and below the sample.

To decrease the radiative heat transfer imbalance into the top and bottom of the sample, cooling surfaces are maintained above and below the rotor which are as close to the same temperature as possible and as close to the rotor temperature as possible. This minimizes the convective mixing which occurs in the sample.

Decreasing radiative heat transfer imbalance can also be accomplished by increasing the wall height of the cooling surfaces, adding a cover to the cooling surfaces, adding heat shields to the bottoms of the optical element and/or adding a partially insulating material between the cooling surface walls and bottom. Through these means, the system can be tuned to minimize the convective mixing in the sample.

The outside of the cooling surfaces can be shiny to reduce the absorption and emissivity and therefore heat transfer between the chamber and the cooling surfaces. The cover can include a double layer of insulating material to minimize the thermal transfer between the cover and the chamber.

It is understood that the embodiments described herein are for illustrative purposes only and that various modifications or changes in light thereof will be suggested to persons skilled in the art and are to be included within the spirit and purview of this application and scope of the appended claims.

What is claimed is:

1. A centrifuge comprising:

a. a rotor including a rotor surface;

b. a centrifuge chamber configured to enclose the rotor; and c. a first cooling surface to absorb heat from the rotor surface, the first cooling surface disposed inside the centrifuge chamber, the first cooling surface arranged facing and spaced-apart from the rotor surface, the first cooling surface sized to cover at least a portion of the perimeter of the rotor surface, the first cooling surface being adjustable to accommodate different sized rotors in the centrifuge chamber; and d. a thermal element thermally coupled to the first cooling surface to adjust the temperature of the first cooling surface, the thermal element disposed inside the centrifuge chamber, the thermal element is reversibly coupled to the first cooling surface to allow removal of the first cooling surface from the centrifuge chamber.

2. The centrifuge of claim 1, wherein the portion of the perimeter covered by the first cooling surface is a segment of the perimeter.

3. The centrifuge of claim 1, wherein the first cooling surface surrounds the rotor.

4. The centrifuge of claim 1, wherein the height of the first cooling surface is less than or approximately equal to the height of the rotor.

5. The centrifuge of claim 1, wherein the height of the first cooling surface is less than 120% of the height of the rotor.

6. The centrifuge of claim 1, wherein the spaced-apart distance between the first cooling surface and the rotor surface has a minimum clearance of less than 15 millimeters.

7. The centrifuge of claim 1, wherein the spaced-apart distance between the first cooling surface and the rotor surface has a minimum clearance of less than 10 millimeters.

8. The centrifuge of claim 1, wherein the spaced-apart distance between the first cooling surface and the rotor surface has a minimum clearance of less than 5 millimeters.

9. The centrifuge of claim 1, further comprising a second cooling surface arranged facing and spaced-apart from the rotor surface to absorb heat from the rotor surface.

10. A centrifuge comprising:

a. a rotor including a rotor surface, the rotor configured to hold a sample;

b. a centrifuge chamber configured to enclose the rotor; and c. a cooling assembly disposed inside the centrifuge chamber, the cooling assembly including a cooling surface, a thermal element, and a heat pipe, the cooling surface arranged spaced-apart and facing the rotor surface to absorb heat from the rotor surface, the cooling surface being adjustable to accommodate different sized rotors in the centrifuge chamber, the thermal element coupled to the cooling surface to adjust the temperature of the cooling surface, the heat pipe coupled to the thermal element and arranged to transfer heat from the thermal element to outside the centrifuge chamber.

11. The centrifuge of claim 10, further comprising a heat sink disposed outside the centrifuge chamber, the heat sink coupled to the heat pipe to dissipate the heat transferred from the thermal element.

12. The centrifuge of claim 10, wherein the rotor includes a window to view the sample, the centrifuge further comprising an optical element disposed outside the centrifuge chamber to deliver a beam of light to the window.

13. The centrifuge of claim 12, further comprising a light source and a detector disposed outside the centrifuge chamber, wherein the light source is arranged to deliver the beam of light to the optical element, wherein the rotor further includes a second window, and wherein the detector is arranged to receive the beam of light emitted through the second window.

14. The centrifuge of claim 13, wherein the centrifuge chamber includes a chamber floor, wherein the light source and the detector are disposed beneath the chamber floor.

15. A centrifuge comprising:

a. a rotor configured to hold a sample;

b. a drive coupled to the rotor to spin the rotor; and c. a cooling surface arranged facing and spaced-apart from the rotor to cool the rotor, wherein the cooling surface is adjustable to accommodate different sized rotors and the cooling surface is removably mounted within the centrifuge.

16. The centrifuge of claim 15, wherein the minimum clearance between the rotor and the cooling surface is less than 10 millimeters.

17. The centrifuge of claim 15, wherein the minimum clearance between the rotor and the cooling surface is less than 5 millimeters.

18. The centrifuge of claim 15, further comprising a centrifuge chamber configured to enclose the rotor, wherein the cooling surface is disposed inside the centrifuge chamber.

19. The centrifuge of claim 1, wherein the first cooling surface is divided into individual segments and each individual segment covers only a portion of the perimeter of the rotor surface.

20. The centrifuge of claim 19, wherein each individual segment covering only a portion of the perimeter of the rotor surface is adjustable to accommodate different-sized rotors in the centrifuge chamber.

21. The centrifuge of claim 19 or 20, wherein there is space between adjacent individual segments.

22. The centrifuge of claim 19 or 20, wherein there is no space between adjacent individual segments.

* * * * *